US010947744B1

(12) United States Patent
Barsamian

(10) Patent No.: US 10,947,744 B1
(45) Date of Patent: Mar. 16, 2021

(54) HAND TOOL FOR CLEANING MASTIC FROM TILE SPACING LINES

(71) Applicant: Aram Khachik Barsamian, La Verne, CA (US)

(72) Inventor: Aram Khachik Barsamian, La Verne, CA (US)

( * ) Notice: Subject to any disclaimer, the term of this patent is extended or adjusted under 35 U.S.C. 154(b) by 0 days.

(21) Appl. No.: 13/899,557

(22) Filed: May 21, 2013

Related U.S. Application Data

(60) Provisional application No. 61/649,864, filed on May 21, 2012.

(51) Int. Cl.
*E04F 21/165* (2006.01)
*E04F 21/16* (2006.01)
*E04F 21/00* (2006.01)

(52) U.S. Cl.
CPC ..... *E04F 21/165* (2013.01); *E04F 21/0084* (2013.01); *E04F 21/16* (2013.01); *E04F 21/1652* (2013.01)

(58) Field of Classification Search
CPC ..... E04F 21/00; E04F 21/0084; E04F 21/16; E04F 21/161; E04F 21/162; E04F 21/165; E04F 21/1652
USPC ..... 15/105.5, 235.3, 235.4, 235.6, 236.01, 15/236.05–236.09, 245.1; 425/458; D8/45; D32/46
See application file for complete search history.

(56) References Cited

U.S. PATENT DOCUMENTS 1,195,297 A * 8/1916 Vlchek ..... E04F 21/165 15/104.012
3,686,703 A * 8/1972 Ray ..... E04F 21/22 15/235.4
3,761,992 A * 10/1973 Schneller ..... E04F 21/165 15/210.1
4,211,501 A * 7/1980 Pedroso ..... B05C 17/00516 15/235.7
7,484,263 B2 * 2/2009 Rice ..... E04F 21/0084 15/105.5

FOREIGN PATENT DOCUMENTS

| | | | |
|---|---|---|---|
| DE | 29801028 | * | 4/1998 |
| DE | 19757908 | * | 7/1999 |
| DE | 19847514 | * | 5/2000 |
| DE | 10053066 | * | 4/2002 |
| FR | 2762030 | * | 10/1998 |
| WO | 97/44551 | * | 11/1997 |

OTHER PUBLICATIONS

Partial machine translation of WO 97/44551, Nov. 27, 1997.*
https://www.artmolds.com/shore-hardness/, 3 pages.*
Partial machine translation of FR 2,762,030, Oct. 16, 1998.*

* cited by examiner

*Primary Examiner* — Mark Spisich
(74) *Attorney, Agent, or Firm* — Morriss O'Bryant Compagni Cannon, PLLC

(57) ABSTRACT

The invention is hand tool and methods of use therefor for removing excess mastic and other debris from spacing between tiles. The device has a polygonal body, with a single projection extending from each side. Each projection has a different width and/or length, and is sized to fit in the spacing between adjacent tiles. Methods of installing and/or renovating and/or repairing tile with the hand tool are also disclosed.

9 Claims, 5 Drawing Sheets

FIG. 1A
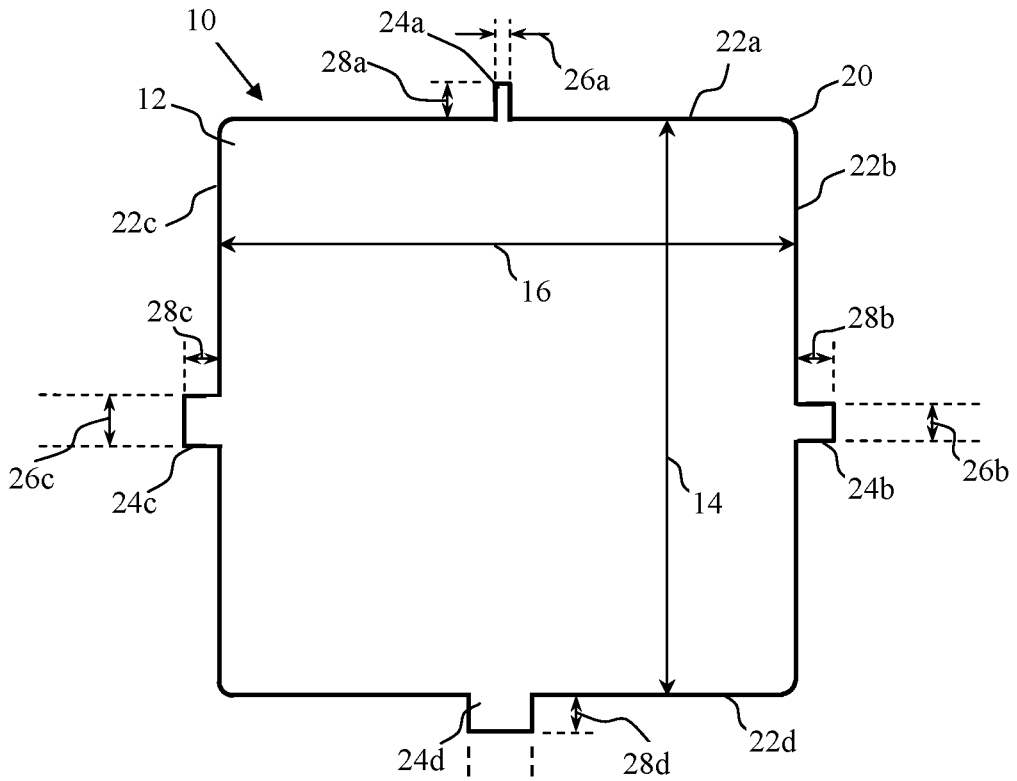
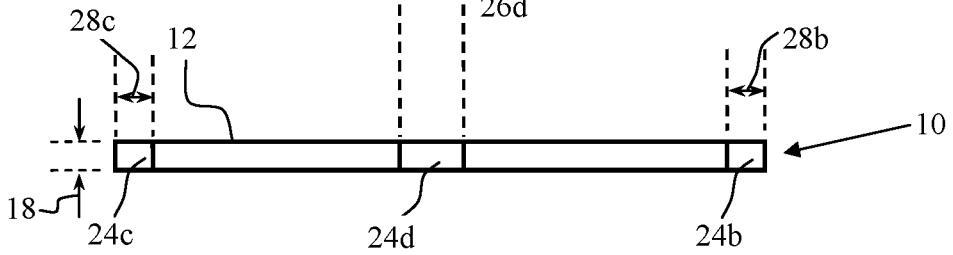
FIG. 1B

FIG. 3A
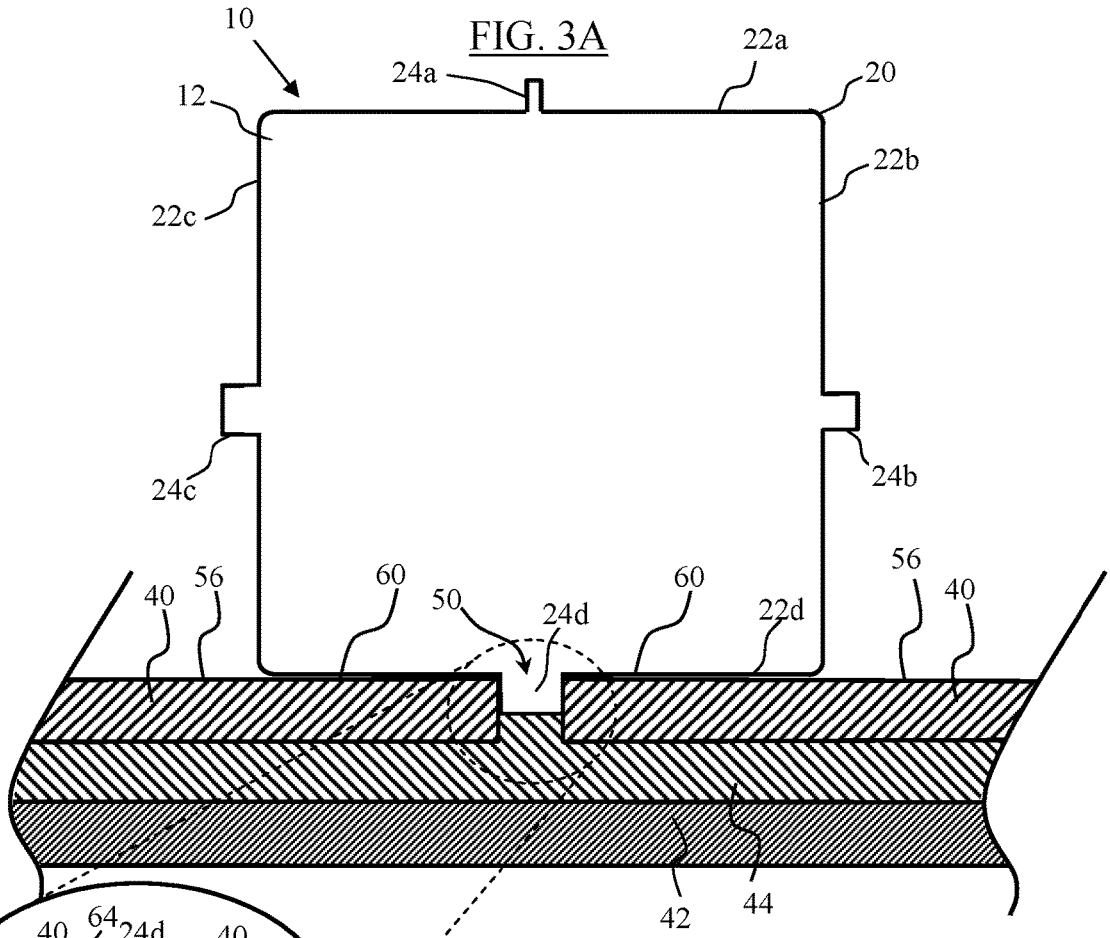
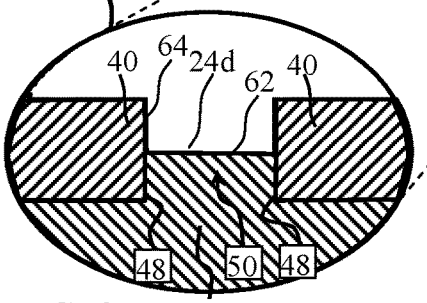
FIG. 3B
FIG. 3C
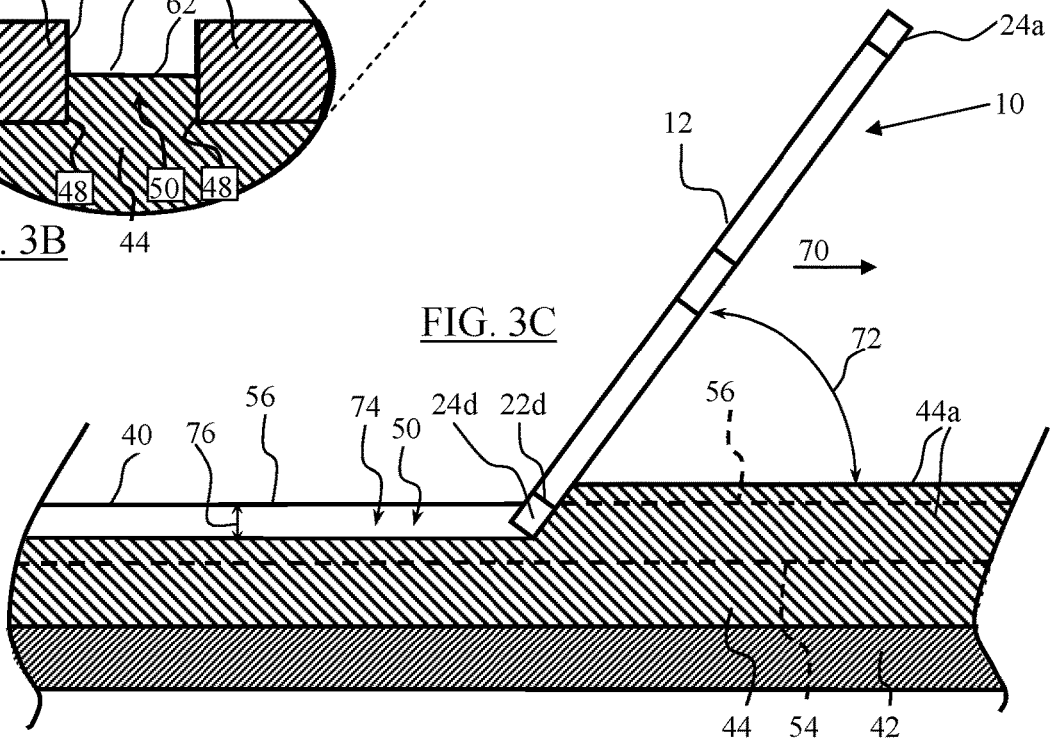

HAND TOOL FOR CLEANING MASTIC FROM TILE SPACING LINES

RELATED APPLICATIONS

The present application claims priority from U.S. Provisional Application No. 61/649,864, filed May 21, 2012 and entitled "Hand Tool for Cleaning Mastic from Tile Spacing Tiles," the entire contents of which are expressly incorporated herein by reference.

FIELD OF THE INVENTION

The invention relates generally to the field of construction tools, and more particularly to an improved hand tool for removing excess mastic and other debris from tile spacing lines.

BACKGROUND OF THE INVENTION

Installing tile typically involves using an adhesive (typically referred to as mastic) to secure the tiles to a subsurface. The tiles are typically spaced apart along seams (which are the spaces between adjacent tiles). Excess mastic is removed from the seams in order to leave a recess of sufficient depth for later-applied grout to be firmly seated. After the mastic is dried, grout is applied to the seams to provide a firm seal and also to provide a smooth, visually-appealing transition between tiles.

Cleaning the excess mastic and other debris from between the tiles is time-consuming and difficult. It is important to remove mastic fully to the tile edges and to a depth sufficient to leave a seam with sufficient depth to firmly seat the later-applied grout, but it is also important not to remove too much mastic in order to assure that some mastic remains toward the bottom of the seam so that the mastic serves to bond adjacent tiles. Ideally, after cleaning out of the excess mastic there will remain a seam between tiles that is of relatively constant dimension, where all mastic s cleaned from the upper portions of the edges of adjacent tiles, but where some mastic remains toward the bottom of the seam and extending between the adjacent tiles to secure the adjacent tiles together. It is also important to clean the mastic that may have been inadvertently applied to the upper surface of the tile during installation.

What has been needed is method and device for efficiently and easily cleaning excess mastic and other debris from tile seam lines. The current invention meets those needs.

SUMMARY OF THE INVENTION

The invention is a method, system, and device for removing excess mastic and other debris from between tile edges, e.g., within seams between adjacent tile pieces.

In an embodiment of the invention, a hand tool having multiple straight sides is provided, with each side having a rectangular projection extending from the side from about the middle of the side. All elements (i.e., main body and projections) of the hand tool may be formed as a unitary body, such as from a molded rubber or thermoplastic block, such as is formed via a single-pour molding process. Materials may include rubber, neoprene, and/or polyurethane or other polymers. The resulting structure should not be entirely stiff/rigid, but should have sufficient flexibility so that the hand tool edges can engage the tile surface in a squeegee-like fashion without scratching the surface of the tile. Examples of materials for use for the hand tool include materials, such as polyurethanes, having shore hardness from A55 to D50.

Each projection may be sized to fit relatively snugly into a different-width seam between adjacent tiles. After the tiled is installed via mastic, but prior to the mastic drying, a selected side of the hand tool can be placed against adjacent tiles, with the rectangular projection extending into the seam so that the opposing edges of the rectangular projection engage against the edges of the adjacent tiles that define the seam. With downward pressure applied by the user, the hand tool can be slid along the seam, with the selected side cleaning, in a "squeegee" fashion, the excess mastic from the tile upper surfaces, while the projection simultaneously cleans the excess mastic from the seam and leaves a substantially rectangular seam trough having relatively constant depth. After the cleaning is completed for all tiles and seams, the mastic is allowed to set. After the mastic is set, grout can be applied into the seams.

The rectangular and relatively deep seam trough formed by the hand tool is particular helpful in providing a well-formed recess (i.e., seam trough) that can securely seat subsequently-applied grout. This is in contrast to more shallow seam troughs, which may have a shallow curved or V-shape (such as might be formed with a semi-circle or V-shaped projection), subsequently-applied grout might not be able to set securely with the seam trough, with the result that the grout after drying might easily flake out of the seam trough. By contrast, the current invention provides a relatively deep trough with steep sides in which grout can be securely seated.

The tool can also be used in removing and replacing old grout. For example, after much of the old grout has been machined or otherwise removed (e.g., using known methods, such as small rotating grout saws), the device of the invention may be used to clean loose and/or fine grout pieces and other debris that may have fallen in (or back in) to the seam.

Further details of various embodiments of the devices and methods of the invention are set forth in greater detail below with respect to the below-referenced drawings.

BRIEF DESCRIPTION OF THE DRAWINGS

FIGS. 1A-1D depict top, side, (side (close-up), and side (close-up) views, respectively, of a hand tool according to an embodiment of the invention;

FIGS. 3A-3C depict front (partial cross-section), front (close-up, partial cross-section), and side (partial cross-section) views, respectively, of a hand tool removing mastic from a tile seam according to an embodiment of the invention;

DETAILED DESCRIPTION OF PREFERRED EMBODIMENTS

Figure 1C:
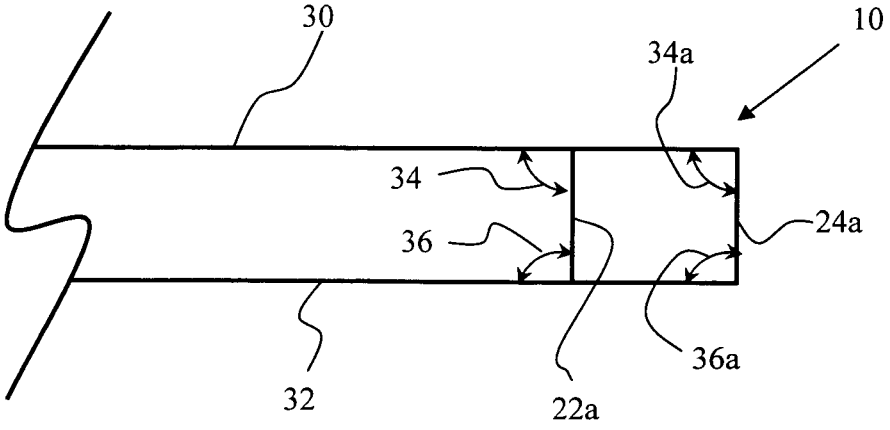

As depicted in FIGS. 1A-1B, a hand tool 10 according to an embodiment of the invention includes a main body 12 having a length 14, width 16, and thickness 18. In the particular embodiment depicted, the length 14 and width 16 are substantially equal, with the main body 12 forming a substantially square shape. The corners 20 of the main body in the embodiment depicted are rounded, although unrounded corners are also within the scope of the invention.

Various dimensions are within the scope of the invention. Examples of dimensions of preferred embodiments include thicknesses of 1/32 to 1 inch, 1/16 to 1/2 inch, 1/8 to 1/4 inch, and/or about 1/8 inch. Widths/lengths of preferred embodiments may be between 1 and 5 inches, between 2 and 4 inches, and/or about 3 inches. While a substantially square-shaped main body 12 is depicted, other multi-sided shapes are also within the scope of the invention, including non-square rectangles (i.e., with length unequal to width), triangle, pentagon, and other polygonal shapes. The particular dimensions for a specific hand tool according to the invention may depend on the particular application, including aspects such as the materials forming the hand tool 10, etc.

In the particular embodiment depicted, the hand tool 10 has four sides 22*a*-22*d*. Extending from the middles of each side 22*a*-22*d* are projections 24*a*-24*d*. In the particular embodiment depicted, the projections have the same thickness 18 as the main body 12, although other thicknesses are also within the scope of the invention. Each projection may have a different width 26*a*-26*d* from the other projections. In a preferred embodiment, projection widths include about 1/16 inches (for 26*a*), about 1/18 inches (for 26*b*), about 3/16 inches (for 26*c*), and about 1/4 inches (for 26*d*). Each projection 24*a*-24*d* has a length 28*a*-28*d*. The lengths 28*a*-28*d* of different projections may be equal, or may be different. In one embodiment, all projections 24*a*-24*d* have identical lengths 28*a*-28*d*. Examples of ranges for lengths 28*a*-28*d* according to preferred embodiments include between 1/16 and 1/2 inch, between 1/8 and 1/4 inch, and/or about 3/16 inch. In one particular embodiment of the invention, the main body 12 is square with a width and length of about 3 inches; all projections have a length of about 3/16 inches; projection widths include about 1/16 inches (for 26*a*), about 1/18 inches (for 26*b*), about 3/16 inches (for 26*c*), and about 1/4 inches (for 26*d*); and the device (including main body and projections) has a thickness of about 1/8 inch. In the embodiment depicted, each projection 24*a*-24*d* forms a rectangular shape extending from the main body 12.

Figure 1D:
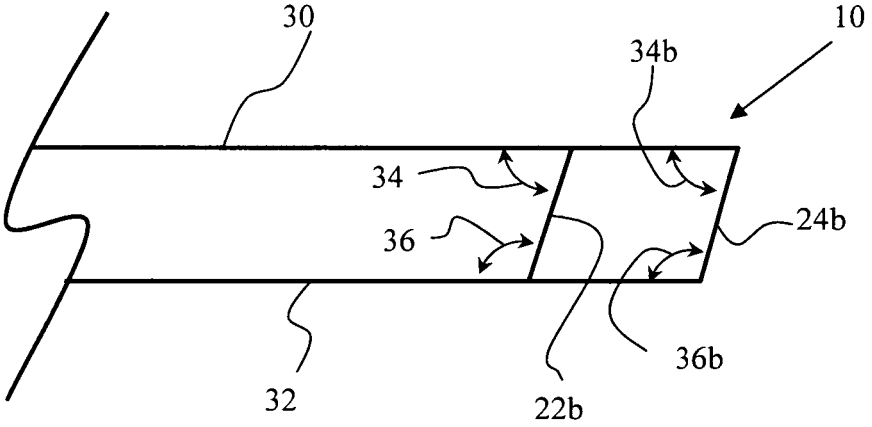

As seen in FIG. 1C, a hand tool 10 according to an embodiment of the invention may have one or more (or all) sides 22*b* which are at angles 34, 36 of 90 degrees from the upper and lower surfaces 30, 32 of the hand tool. As seen in FIG. 1D, a hand tool 10 according to an embodiment of the invention may have one or more (or all) sides 22*b* which are at angles 34, 36 which depart from 90 degrees from the upper and lower surfaces 30, 32 of the hand tool. For example, an angle 34 may be 80 to 87 degrees to provide a slightly sharper "point" on the upper edge formed between side 22*b* and surface 30. Similarly, an angle 36 may be 93 to 110 degrees to provide a slightly less sharp edge between side 22*b* and surface 32. A user could select which edge to use (e.g., more sharp or less sharp) depending on the particular mastic, tile, etc. Note that similar angles and ranges may be provided to one or more or all of the projections (e.g., 24*b*).

Various materials may be used to form devices of the invention. For example, a device according to the invention may be formed as a unitary piece, such as from a molded rubber or thermoplastic block which may be formed via a single-pour molding process. Materials may include rubber, neoprene, and/or polyurethane or other polymers having sufficient flex to act in squeegee-like fashion. The resulting structure should not be entirely stiff/rigid, but should have sufficient flexibility so that the hand tool edges can engage the tile surface in a squeegee-like fashion without scratching the surface of the tile. Examples of materials for use for the hand tool include materials, such as polyurethanes, having shore hardness from A55 to D50.

Figure 2A:
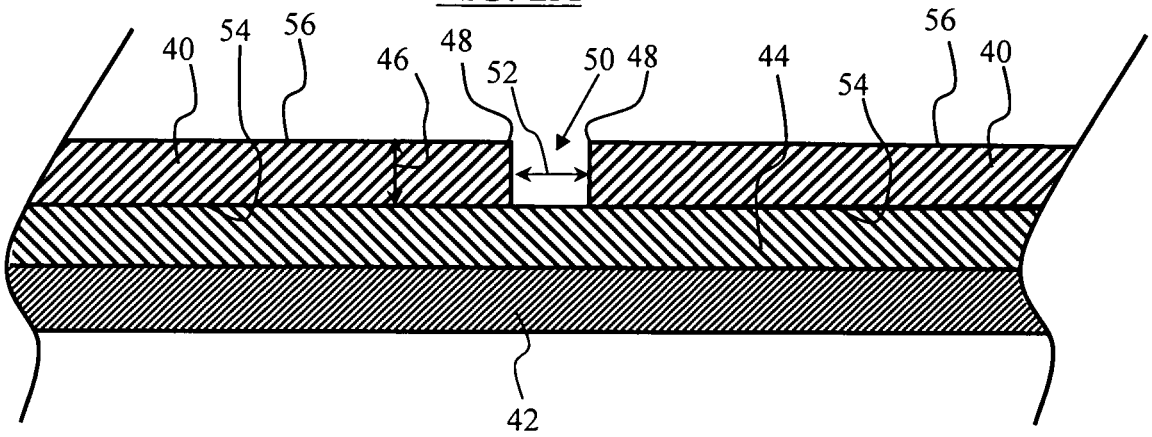
FIGS. 2A-2B depict front (cross-section) and front (cross-section) views of a tile assembly for use with the current invention.
Figure 2B:
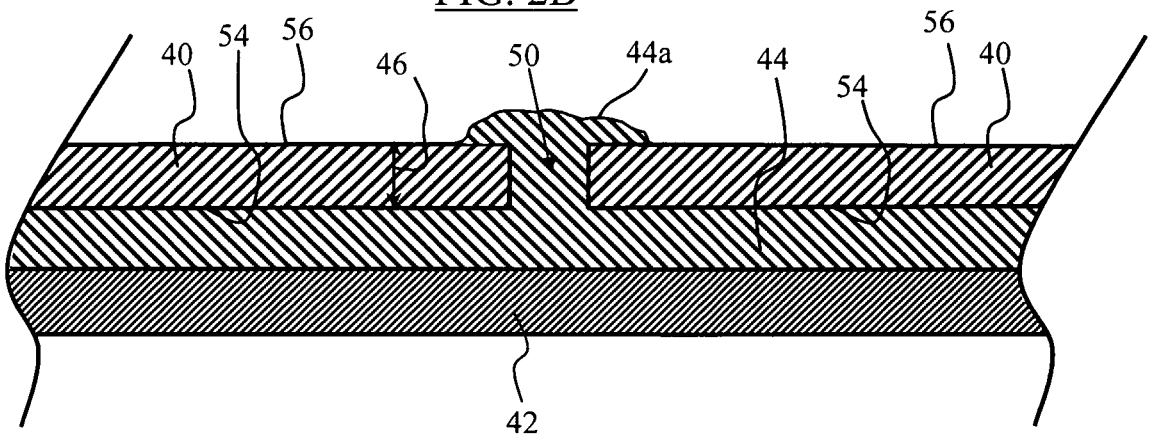

Methods of using the device during installation of tile for removal of excess mastic are depicted in FIGS. 2A-2B and 3A-3C. In FIG. 2A, tiles 40 have been lightly applied to a subsurface 42 via mastic 44. The tiles, which have a thickness 46, have adjacent edges 48 which are spaced apart by a seam 50 having a width 52. As depicted in FIG. 2B, after the tiles 40 are pressed firmly down to seat/adhere their lower surfaces 54 into the mastic 44, excess mastic 44*a* is forced up through the seam 50 (and therefore between adjacent tile edges 48) and over a portion of the top surface(s) 56 of the tiles 40.

Prior to the mastic 44 drying, the user compares the seam width 52 against the widths of the projections 24*a*-24*d* of the device 10, and selects the projection (e.g., projection 24*d*) having the width that most closely fits into the seam 50. As depicted in FIG. 3A, the user places the hand tool side 22*c* against the tiles top surfaces 56, with the projection 24*c* extending into the seam 50 to a depth 58 well below the tiles top surfaces 56, but which may not be so deep as to reach the tiles lower surfaces 54. The sides 22*a*-22*d* of the hand tool 10 are flat and substantially straight to either side of the center projection of that particular side (i.e., are flat and substantially flat all the way from the projection to the near corner defining the end of that side), and also have some flex due to the material from which they are formed, and thus present flat squeegee-type surfaces 60 against the tile top surfaces 56 on either side of the seam 50. The flat squeegee-style surfaces 60 of the side(s) are thus suitable for removing excess mastic in squeegee fashion from the top surfaces 56 of the tiles 40. As depicted more clearly in the close-up view of FIG. 3B, the rectangular shape of the projection 24*d* of the selected side is particular suitable for extending well into a selected tile seam 50, with the tip 62 of the projection positioned well below the tile top surfaces, and the sides 64 of the projection 24*d* (when the selected projection is properly matched to the seam width) engaging against adjacent tile edges 48 on either side of the seam 50.

As depicted in FIG. 3C, with the projection 24*d* positioned in the seam 50, the user can draw the hand tool 10 in a desired direction 70 with the selected side 22*d* engaging along the tile top surface 56, with the side 22*d* serving to remove, in squeegee fashion, the excess mastic 44*a* from the tile top surface 56. Simultaneously, the projection 24*d* is drawn through the seam 50 to remove excess mastic 44*a* therefrom and thereby form a deep rectangular trough in the seam 50. The user can hold the hand tool 10 with the main body 12 held at an angle 72 from the tile top surface 56 with respect to the tile top surface 56 as the device 10 is drawn across the tile in order to improve the mastic removal, and/or to achieve a desired depth of the resulting seam trough. Such an angle 72 may be between 30 and 90 degrees; about 45 degrees; about 60 degrees; just under 90 degrees; between 60 and 90 degrees; etc. The device 10 thus uses its projection 24*d* to smoothly clean out the excess mastic or other material in the tile spacing, leaving behind a trough between the tiles of sufficient depth in which grout can be firmly seated, while the flat side 22*d* flat surfaces 60 on either side of the projection 24*c* firmly engage against the tiles top surfaces 56 to clean (in squeegee fashion) the excess mastic 44*a* therefrom. As can be seen in the area cleaned of mastic by the device 10 (which is the left of the device 10 in FIG. 3C), a trough 74 is formed in the seam 50 to a depth 76 below the tile top surface 56, while in the area that has not yet been cleaned of mastic (i.e., through which the device has not yet passed, which is to the right of the device 10) the excess mastic 44*a* still extends up and over the tile top surface 56. After the device 10 has cleaned the seam 50 of excess mastic 44*a*, the result is a relatively deep rectangular trough 74 in the tile seam 50 that can securely receive and hold tile grout. Note that it may be desirable for the trough 74 to be deeper than it is wide to assist in securing the grout firmly into the seam.

Figure 4:
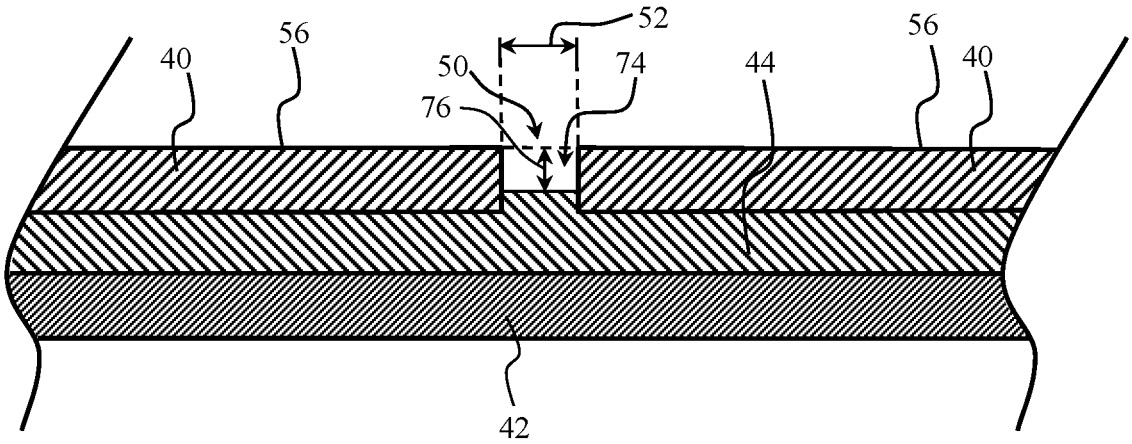
FIG. 4 depicts a front (cross-sectional) view of a tile assembly with a seam trough formed according to an embodiment of the invention.

FIG. 4 depicts the seam trough 74 formed by the hand tool 10 in the tile seam 50. The seam trough 74 is substantially rectangular in shape, and extends substantially the entire width 52 of the seam between the tiles 40, with the trough depth 76 sufficient to receive and seat grout to be applied after the mastic has set. The remaining mastic 44 when set will secure the tiles 40 securely to the subsurface 42 and to adjacent tiles 40. Note that some additional cleaning of excess mastic via other tools (e.g., sponges, squeegees, etc.) may be used in addition to the use of the hand tool 10 of the invention, such as being used after, or in between, hand tool use to clean fine mastic particles that may remain on the tile top surfaces 56.

Figure 5:
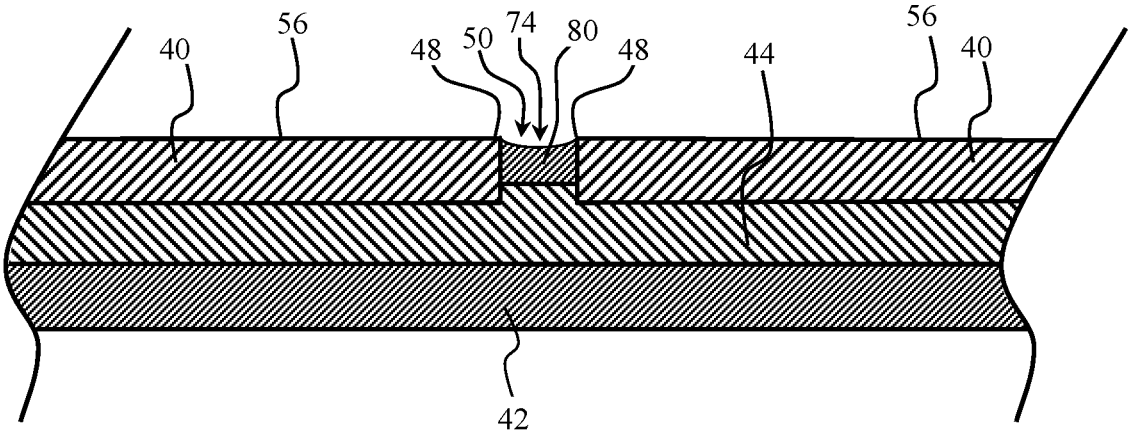
FIG. 5 depicts a front (cross-sectional) view of a tile assembly with grout applied to a seam trough formed according to an embodiment of the invention.

FIG. 5 depicts the seam 50 with grout 80 added into the seam trough 74 between the tiles 40. Typically the grout 80 is added after the mastic 44 is set, with the grout 80 typically providing a water-tight seal and/or relatively smooth upper surface to the area between the tiles 40. Note that the grout is typically applied to leave only a relatively shallow portion of the seam exposed, so that dirt and other debris cannot easily collect in large amounts in the seam. Such grout can be added using conventionally known methods.

Although the invention has been described in terms of particular embodiments and applications, one of ordinary skill in the art, in light of this teaching, can generate additional embodiments and modifications without departing from the spirit of or exceeding the scope of the claimed invention. For example, although the above devices and methods are described for use in a particular manner, the devices and methods described herein could be used in a variety of different methods of use. Accordingly, it is to be understood that the drawings and descriptions of specific embodiments herein are proffered by way of example to facilitate comprehension of the invention, and should not be construed to limit the scope thereof.

What is claimed is:

1. A hand tool for cleaning mastic from grout lines of tile, the hand tool comprising:

a main body comprising a substantially flat polygon defined by a substantially planar top and bottom surface and a plurality of substantially straight and flat sides about the periphery thereof, each of the sides extending between a respective pair of corners at the periphery of the body;

a plurality of projections integrally formed with the main body, wherein a single one of the projections extends from a respective one of the sides of the body, each of the projections being substantially rectangular in shape with each projection having a width that is different than the other projections, a top and bottom of each projection being substantially coplanar with the respective top and bottom surfaces of the main body, each of the projections further having a substantially flat distal end spaced from the respective flat side of the main body, each projection distal end and the associated flat side of the main body being beveled so as to define an angle relative to the top surface of the main body, the bevel of each projection distal end and the respective flat side of the main body being substantially equal such that they define substantially parallel surfaces; and wherein the main body and integral projections are formed as a unitary piece and the main body and projections are formed of a material having degree of flexibility having a Shore hardness from A55 to D50.

2. The hand tool of claim 1, wherein the main body comprising the substantially flat polygon further comprises a substantially triangular shape, wherein the plurality of substantially straight and flat sides consists of three sides.

3. The hand tool of claim 1, wherein the main body comprising the substantially flat polygon further comprises a substantially rectangular shape, wherein the plurality of substantially straight and flat sides consists of four sides.

4. The hand tool of claim 3, wherein the main body comprising the substantially flat polygon further comprises a substantially square shape, wherein the plurality of substantially straight and flat sides consists of four sides.

5. The hand tool of claim 1, wherein the main body comprising the substantially flat polygon has a thickness which is substantially uniform across the main body and the plurality of projections.

6. The hand tool of claim 5, wherein the thickness is in the range from ⅛ to ¼ inch.

7. The hand tool of claim 6, wherein the hand tool main body has a maximum width of between 2 and 4 inches.

8. The hand tool of claim 1, wherein each side is at an angle of 80 to 87 degrees or 93 to 110 degrees from the top of the hand tool.

9. The device of claim 1, wherein the material comprises rubber, neoprene, or polyurethane.

* * * * *